US006715183B1

(12) United States Patent
Lautenschläger

(10) Patent No.: US 6,715,183 B1
(45) Date of Patent: Apr. 6, 2004

(54) SNAP HINGE

(75) Inventor: Gerhard Lautenschläger, Brensbach (DE)

(73) Assignee: Mepla-Werke Lautenschlager GmbH & Co. KG, Reinheim (DE)

( * ) Notice: Subject to any disclaimer, the term of this patent is extended or adjusted under 35 U.S.C. 154(b) by 0 days.

(21) Appl. No.: 10/089,391

(22) PCT Filed: Aug. 28, 2000

(86) PCT No.: PCT/EP00/08356

§ 371 (c)(1),
(2), (4) Date: May 22, 2002

(87) PCT Pub. No.: WO01/23697

PCT Pub. Date: Apr. 5, 2001

(30) Foreign Application Priority Data

Sep. 29, 1999 (DE) ..... 299 17 107 U

(51) Int. Cl.[7] ..... E05F 1/08

(52) U.S. Cl. ..... 16/286; 16/287; 16/280; 16/291; 16/294

(58) Field of Search ..... 16/286, 287, 288, 16/335, 366, 280, 291, 294

(56) References Cited

U.S. PATENT DOCUMENTS

| | | | | |
|---|---|---|---|---|
| 4,449,269 A | * | 5/1984 | Sundermeier et al. | 16/50 |
| 4,641,394 A | * | 2/1987 | Rock et al. | 16/302 |
| 5,008,977 A | * | 4/1991 | Lautenschlager et al. | 16/278 |
| 5,373,609 A | * | 12/1994 | Ferrari et al. | 16/370 |
| 5,481,782 A | * | 1/1996 | Grabher | 16/258 |
| 5,604,956 A | * | 2/1997 | Grass | 16/278 |
| 5,634,242 A | * | 6/1997 | Ferrari et al. | 16/370 |
| 6,237,191 B1 | * | 5/2001 | Ferrari et al. | 16/335 |

FOREIGN PATENT DOCUMENTS

| | | | |
|---|---|---|---|
| DE | 2541144 A1 | * | 3/1977 |
| EP | 0724059 A1 | * | 7/1996 |
| GB | 2007756 A | * | 5/1975 |
| JP | 9-328950 | * | 12/1997 |

* cited by examiner

*Primary Examiner*—Chuck Y. Mah
(74) *Attorney, Agent, or Firm*—Norris McLaughlin & Marcus

(57) ABSTRACT

A hinge (10) for furniture doors, the supporting wall stop part of which, which is constructed as a supporting arm (14), is coupled pivotably over two hinge guide rods (16; 18) with the door stop part, which is constructed as a hinge pot (12), with a spring-loaded mechanism, which it is formed by a leg spring, which is disposed in the supporting arm and engages an extension of the out to hinge guide rod (16), and a further leg spring, which is supported in the supporting arm. The leg spring is constructed as a double leg spring (42) with a middle double leg (44) of two parallel leg arms, protruding between two groups of spring coils (47) from, in each case, one of the inner spring coils, and two outer legs (46), protruding from the in each case outermost spring coil of each group. The middle double leg is constructed arc-shaped at its free end and embraces the hinge pin (22), which carries the inner hinge guide rod pivotably, at least partially with this arc-shaped end through a central recess in the bearing lug (38) of the inner hinge guide rod (18) on the side of the supporting arm and is held rotatably on the hinge pin (22). The free ends of the legs (46), protruding from the outer spring coils, are held in a recess (50) of the extension of the outer hinge guide rod so that they can be rotated about an axis extending parallel to the axis of the hinge pin (20) of the outer hinge guide rod (16) on the side of the supporting arm, the double leg spring (42) being held exclusively by the double leg (44) and the outer leg (46) in the supporting arm (14).

2 Claims, 2 Drawing Sheets

Figure 5:
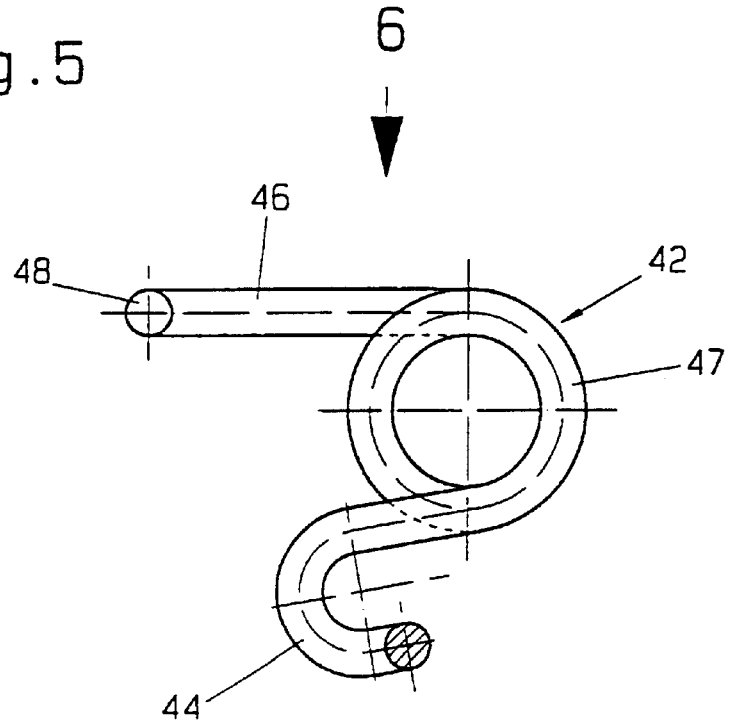

Fig.1
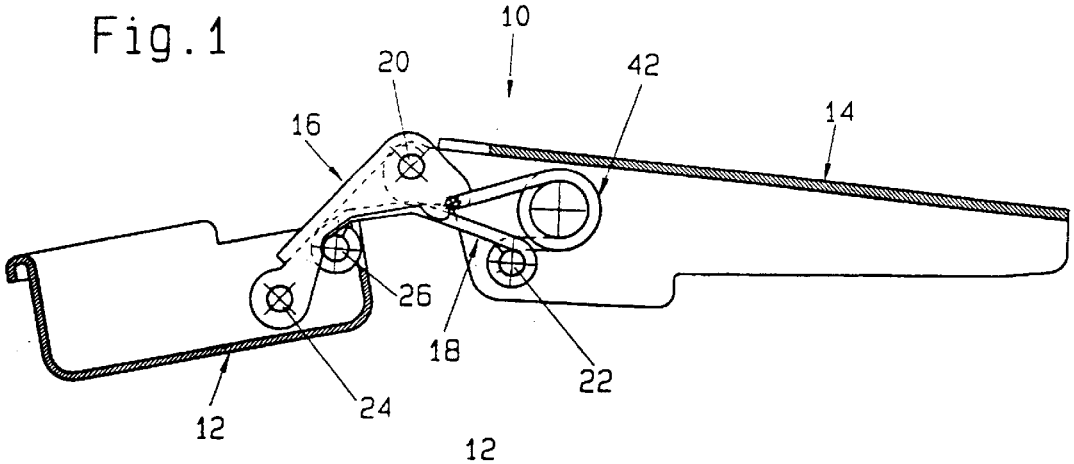
Fig.2
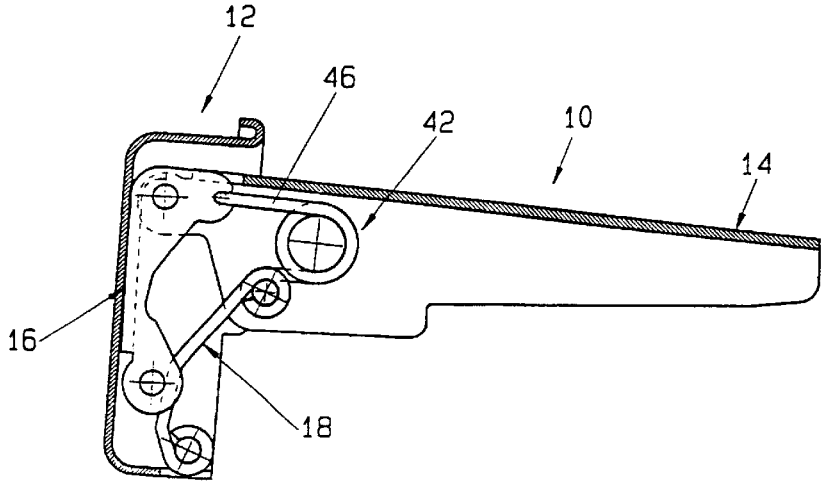
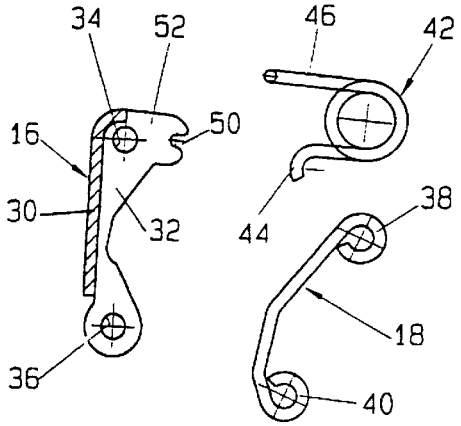
Fig.3
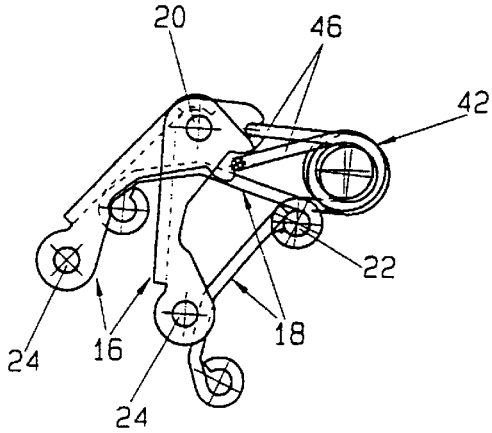
Fig.4

SNAP HINGE

The invention relates to a spring-loaded hinge for furniture doors with two hinge guide rods, pivotably hinged, on the one hand, at a door stop part and, on the other, at a supporting wall stop part, which is constructed as an extended supporting arm, in the form of a quadruple joint. In the course of swiveling from the closed position into the open position, the quadruple joint can be moved over a dead center position, on this side of which it is pushed by the tension of a leg spring into the closed position and on the other side of which it is pushed by the tension of the leg spring into the opening direction, one leg of the leg spring, disposed in the door-side end region of the supporting arm, engaging an extension of the outer hinge guide rod, which is remote from the supporting wall, forming a lever arm with the swiveling axis of this guide rod on the side of the supporting arm and the other leg of the leg spring being supported at the hinge pin of the inner hinge guide rod on the side of the supporting arm.

In the case of known spring-loaded hinges with leg spring (DE 27 03 498 C2), the leg spring is held in the intended position in the interior of the supporting arm by a pin, which passes through the leg spring and is riveted in the lateral side walls of the supporting arm. Since they carry out swiveling motions during the opening and closing movement of the hinge from the extension of the outer hinge guide rod on the one hand and from the end of the leg of the leg spring engaging it, about center points of radii, which are at a distance from one another, the point of attack of the leg at the extension is shifted during the movement of the hinge, as a result of which the lever arm, under which the pre-tension of the leg acts on extension, changes and the region of attack of the leg at the extension is shifted. As a result of the pre-tension of the leg, a not negligible friction occurs between the extension and the leg and, under unfavorable circumstances, can lead to frictional wear in the surfaces sliding on one another. In addition, the portion of the pre-tension of the spring, required to overcome the frictional forces, is unavailable for producing the opening and closing moments of the spring-loaded mechanism. The pre-tension of the leg springs must be increased correspondingly to take into consideration the frictional forces that occur. This, in turn, results in increased frictional wear and requires a corresponding dimensioning of the leg spring.

It is an object of the invention to develop the known hinge so that, during the opening and closing movement of the hinge, translatory sliding movements of the stop region of the leg of the leg spring do not occur at the extension of the outer hinge guide rod.

Starting out from a spring-loaded hinge of the type named above, this objective is accomplished pursuant to the invention owing to the fact that the leg spring is constructed as a double leg spring with a middle double leg of two parallel leg arms, protruding between two groups of spring coils from, in each case, one inner spring coil, and two outer legs, protruding from the in each case outermost spring coil, that the middle double leg is constructed arc-shaped at its free end and embraces the hinge pin, which carries the hinge guide rod pivotably, at least partially with this arc-shaped end through a central recess in the bearing lug of the inner hinge guide rod on the side of the supporting arm and is held rotatably on the hinge pin, that the free ends of the leg, protruding from the outer spring coils, are held in a recess of the extension of the outer hinge guide rod so that they can be rotated about an axis extending parallel to the axis of the bearing pin of the outer hinge guide rod on the side of the supporting arm, and that the double leg spring is held exclusively by the double leg and the outer leg in the supporting arm. The leg spring, which is now constructed as a double leg spring, is thus held exclusively, in the case of the inventive spring-loaded mechanism, by the rotatable mounting of the ends of the double leg at a hinge pin on the one hand and the outer leg is held in the recesses of the extension of the outer hinge guide rod in the interior of the supporting arm, so that the part of the double leg spring, formed by the spring coils, is able to change its position in the interior of the supporting arm without resistance. There is therefore no translatory displacement movement of the ends of the legs engaging the extension of the outer hinge guide rod during the opening and closing movements of the hinge. On the other hand, during the relatively slight rotational movement of the outer ends of the hinge guide rod in the extension, only negligibly little friction develops, so that frictional wear is practically precluded and, essentially, the whole pretension is available for producing the opening or closing moment of the spring-loaded mechanism.

If the outer hinge guide rod is mounted on the side of the supporting arm owing to the fact that it has at its opposite longitudinal edges bent side walls, in which the supporting boreholes for the hinge pin on the side of the supporting arm are provided, the configuration takes place in an inventive, further development so that the extension is formed in each case by an elongation of the side walls, and that in each of the two elongations an open recess is provided, in which in each case an end section of the respective leg of the double leg spring, bent into a position parallel to the axis of the hinge pin, located on the side of the supporting arm, of the outer hinge guide rod, engages rotatably relative to the respective elongation. In contrast to the length of the bent end section of the leg, engaging the underside of the continuation of the outer hinge guide rod of the (single) leg spring of the known hinges, extending essentially over the whole width of the extension, the bent end sections can be kept so short pursuant to the invention that there still is free space between them.

Figure 6:
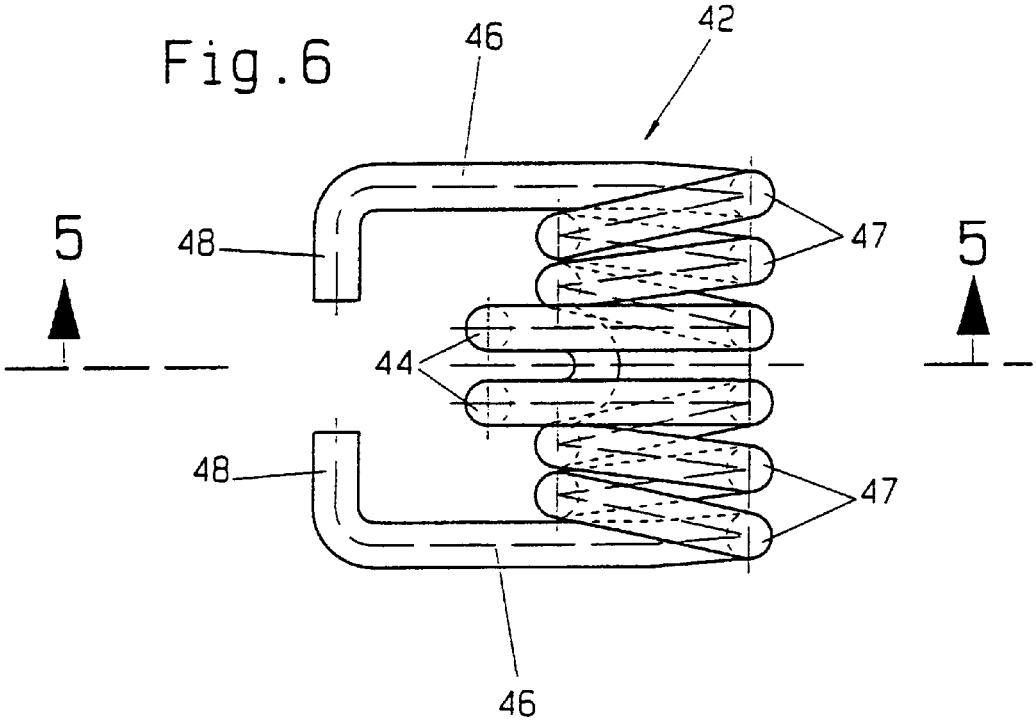

The invention is explained in greater detail in the following description of an example in conjunction with the drawing, in which FIG. 1 shows a longitudinal central section through the supporting arm as well as the doorstop part of an inventive spring-loaded hinge, constructed as an insertion pot, in the open position, FIG. 2 shows a view of the inventive spring-loaded hinge, corresponding to that of FIG. 1, in the closed position, FIG. 3 shows a view of the hinge guide rods and of the leg spring of the hinge of Figures and 2 in an exploded state, FIG. 4 shows a representation of the hinge guide rod and of the hinge spring of the inventive hinge in the spatial assignment in the installed state, the open as well as the closed position being shown in a superimposed position, FIG. 5 shows a sectional view, on a scale larger than that of FIG. 3, of the double leg spring, which functions as an energy-storing device for the spring-loaded mechanism, in the sectional plane, illustrated by arrows 5—5 in FIG. 6 and FIG. 6 shows a plan view of the double leg spring seen in the direction of arrow 6 in FIG. 5.

The inventive hinge, which is shown in FIGS. 1 and 2 in the completely open and completely closed positions and labeled 10 as a whole, is constructed as a so-called quadruple joint hinge, in which the door stop part, which is constructed as a driving-in or insertion pot 12, is pivotably connected over two hinge guide rods 16, 18 with the wall stop part, constructed as an extended supporting arm 14. The supporting arm 14 is held at a supporting or sidewall of a furniture carcass in a manner, which is known and therefore not shown, on an installation plate fastened to the supporting wall.

The quadruple joint mechanism is formed, as already mentioned, by hinge guide rod 16 and 18, the ends of which pass transversely through the interior of the supporting arm or the insertion pot on the side of the supporting arm on hinge pins 20 or 22 and, on the hinge pot side, on hinge pins 24 or 26.

The outer hinge guide rod has two folded-back side walls 32, which are laterally at a distance from opposite longitudinal edges of a stretched-along cross-member part 30 and in which bearing boreholes 34 and 36 for the hinge pins 20 and 24 are provided. On the other hand, the inner hinge guide rod 18 is a flat, extended, punch press, sheet metal part, to the ends of which bearing lugs 38 and 40 are rolled, which embrace the hinge pins 22 and 26.

The energy-storing device of the spring-loaded mechanism of the hinge 10 is formed by a leg spring and, moreover, by the double leg spring 42 shown in detail in FIGS. 5 and 6. Such a double leg spring represents practically the mirror image doubling of a normal leg spring, the legs, protruding in each case at inner spring coils facing one another, being connected with one another in their free end region and thus forming a double leg 44, while the legs 46, protruding from the opposite, outer coils, forming a pair of individual legs 46, which are at a distance from one another. In the region of their free ends, these legs 46 always have short end sections 48, which are bent over into a position extending parallel to the central axis of the hinge pins 20 of the outer hinge guide rod 16 on the side of the supporting arm. These end sections 48 in each case engage a recess 50 in an elongation 52 of the sidewalls 32 of the outer hinge guide rod 16 and are forced into contact with the rounded bottom of the recess 50 by the pre-tension stored in the spring.

In the manner recognizable in FIG. 5, the central double leg 44 of the double leg spring 42 is formed into an arc, which embraces the inner hinge pin 22 supporting the inner hinge guide rod 18 on the side of the supporting arm. So that this becomes possible, the inner guide rod 18 is forked in the region of its bearing lug 38 on the side of the supporting arm by a central recess, which is not shown.

In the stipulated installed position, the double leg spring 42 is thus held exclusively by the end sections 48 of the legs 46, held in the recesses 50 of the elongation 52 and by the arc-shaped end section 44 of the double leg of the double leg spring 42 embracing the hinge pin 22. That is, contrary to the known spring-loaded hinge, the double leg spring is not fixed additionally, for example, by means of a holding pin, which extends transversely through the coils of the double leg spring and is riveted in the side walls of the supporting arm 14. As a result, the movements, transferred during the opening and closing movement by the elongations 52 onto the end sections 48 of the legs 46, are strictly rotational movements, that is, the end sections 48 do not carry out any translatory displacement movement in the recess 50. The bent over end 44 also carries out a strictly rotational movement on the hinge pin 22. At the same time, the spring coils of the double leg spring, which lie in the interior of the supporting arm and are not held fast, are shifted by an amount in the space, which would have resulted in a relative shifting of the end sections 48 in the recess 50 if the spring call had been fixed in the supporting arm 14. This state of affairs is illustrated in FIG. 4, in which the hinge guide rods 16 and 18 as well as the double leg spring 42 are shown superimposed in the completely open and the completely closed positions. It can be seen that the spring coils in the two end positions have a different spatial position in the supporting arm. In contrast to a shifting of the end sections 48 of the legs 46 in the recess 50 of the elongations 52, there is no friction during the spatial shifting of the position of the spring coils in the interior of the supporting arm, so that the frictional forces, which occur in the state of the art, and the frictional wear resulting therefrom are avoided.

What is claimed is:

1. A spring-loaded hinge for furniture doors comprising inner and outer hinge links each having a first and second end, each pivotably hinged to a first and second hinge pin on a door-related mounting part at the first end and to an extended supporting arm at the second end, wherein the extended supporting arm, when swiveling from a closed position to an open position, is movable over a dead center position, wherein in the dead center position, the extended supporting arm is biased toward both the closed and open position by a torsion coil spring, the torsion coil spring, disposed in a door-side end region of the extended supporting arm, being formed as a double leg spring comprising an inner double leg of two parallel leg arms, which protrude between two groups of outer spring coils from a single inner spring coil, the leg arms being integrally connected with one another by a cross member, the double leg spring further comprising two outer legs, each protruding from a respective outermost spring coil of each group, the two outer legs engaging a supporting arm-side extension of the outer hinge link remote from the door-related mounting part, the supporting arm-side extension forming a lever arm with respect to a supporting arm-side swiveling axis of the outer hinge link, the inner double leg being supported at the first hinge pin supporting the inner hinge link in the supporting arm, wherein the ends of the two outer legs, protruding from the respective outermost spring coil of each group, being rotatable about an axis extending parallel to the axis of the second hinge pin supporting the outer hinge link in the supporting arm, are disposed in a recess of the supporting arm-side extension of the outer hinge link, wherein the inner double leg, at its free end connected by the cross member, is constructed arc-shaped and, through a central recess in a supporting arm-side pivot eye of the inner hinge link, embraces the first hinge pin of the supporting arm, which first hinge pin pivotably supports the inner hinge link, at least partially, and the first hinge pin holds the inner hinge link so that the inner hinge link can rotate on the first hinge pin, and the double leg spring being held exclusively by the inner double leg and the two outer legs in the supporting arm.

2. The spring-loaded hinge of claim 1, wherein the outer hinge link comprises, on the supporting arm side thereof, bent-over side walls at its opposite longitudinal edges, the side walls having boreholes for pivotably supporting the second hinge pin of the supporting arm, wherein the extension is formed ,a as an elongation of each of the side walls, the elongation for each of the side walls comprising an open recess in which a bent-over end section of each respective leg of the two outer legs engages so that it can be rotated relative to the respective elongation, the bent-over sections of the two outer legs extending parallel to the axis of the second hinge pin.

* * * * *